US007086417B2

(12) United States Patent
De Almeida

(10) Patent No.: US 7,086,417 B2
(45) Date of Patent: Aug. 8, 2006

(54) GAS FLOW CONTROL DEVICE

(75) Inventor: Alcino Resende De Almeida, Rio de Janeiro (BR)

(73) Assignee: Petroleo Brasileiro S.A. - Petrobras (BR)

( * ) Notice: Subject to any disclaimer, the term of this patent is extended or adjusted under 35 U.S.C. 154(b) by 337 days.

(21) Appl. No.: 08/859,353

(22) Filed: May 20, 1997

(65) Prior Publication Data

US 2001/0025651 A1 Oct. 4, 2001

Related U.S. Application Data

(63) Continuation of application No. 08/186,469, filed on Jan. 26, 1994, now abandoned.

(30) Foreign Application Priority Data

Jan. 27, 1993 (BR) ..... 9300292

(51) Int. Cl.
*F04F 1/08* (2006.01)

(52) U.S. Cl. ..... 138/44; 166/372; 417/108; 417/109; 417/198

(58) Field of Classification Search ..... 137/155; 138/44, 45, 46, 40; 251/333, 324, 332, 359, 251/118; 166/91.1, 372, 374; 417/109, 417/108, 198
See application file for complete search history.

(56) References Cited

U.S. PATENT DOCUMENTS

| | | | | |
|---|---|---|---|---|
| 1,698,826 | A * | 1/1929 | Shaffer | 166/91.1 X |
| 1,761,363 | A | 6/1930 | Porter | |
| 1,802,766 | A * | 4/1931 | Kerr | 138/44 X |
| 1,867,876 | A * | 7/1932 | Clark | 138/44 X |
| 2,994,335 | A | 8/1961 | Dudley | |
| 3,324,803 | A * | 6/1967 | Kelley et al. | 137/155 X |
| 3,672,790 | A | 6/1972 | White et al. | |
| 3,703,273 | A * | 11/1972 | Illing | 251/122 |
| 3,859,853 | A * | 1/1975 | Khuzaie | 138/44 X |
| 4,054,157 | A * | 10/1977 | Moseley, Jr. | 138/40 X |
| 4,090,814 | A | 5/1978 | Teodorescu et al. | |
| 4,390,061 | A * | 6/1983 | Short | 417/172 X |
| 4,506,860 | A * | 3/1985 | von Schwerdtner et al. | 251/359 |
| 4,644,974 | A * | 2/1987 | Zingg | 138/44 |
| 4,688,755 | A * | 8/1987 | Pluviose | 251/122 X |
| 4,726,420 | A * | 2/1988 | Weeks | 166/372 X |
| 4,860,825 | A * | 8/1989 | Corteville et al. | 166/68 |

(Continued)

FOREIGN PATENT DOCUMENTS

| | | |
|---|---|---|
| GB | 122278 | 1/1919 |

(Continued)

OTHER PUBLICATIONS

Gutierrez et al: "New Gas Lift Valve Design Stabilizes Injection Rates," Society of Petroleum Engineers, vol. 36077, Figure 2, Jan. 1996.*

(Continued)

*Primary Examiner*—Kevin Lee
(74) *Attorney, Agent, or Firm*—Nixon & Vanderhye PC

(57) ABSTRACT

Invention is of an improvement to seat of gate valves used for gas-lift producing oil wells, consisting of a seat lower part of which is curved there being a straight vertical art and a sloping straight lower part, central spacing consisting of a first part in the shape of a tapered nozzle at which gas is gradually speeded up, a second part which is the main restriction to flow, and a third part in the shape of a conical diffuser at which gas is gradually slowed down.

11 Claims, 4 Drawing Sheets

U.S. PATENT DOCUMENTS

| | | | | | |
|---|---|---|---|---|---|
| 5,060,686 | A | * | 10/1991 | Troy | 138/44 X |
| 5,066,198 | A | | 11/1991 | Decker | |
| 5,105,889 | A | * | 4/1992 | Misikov et al. | 166/372 |
| 5,374,163 | A | * | 12/1994 | Jaikaran | 417/172 |
| 5,707,214 | A | * | 1/1998 | Schmidt | 417/109 |
| 5,743,717 | A | | 4/1998 | Schmidt | |

FOREIGN PATENT DOCUMENTS

WO WO 96/07813 3/1996

OTHER PUBLICATIONS

James E.A. John; Gas Dynamics Second Edition; Allyn & Backon, Inc., 1984, pp. 49-58.

Chester L. Nachtigal; Instrumentation and Control Fundamentals and Applications; John Wiley & Sons, Inc., 1990, p. 479.

Alhanti et al.; "Continuous Gas-Lift Instability: Diagnosis, Criteria, and Solutions", SPE 26554; 1993, pp. 401-416.

Brown, K. E., "The Technology of Artificial Lift Methods", vol. 2a, Petroleum Publishing Co., Tulsa, 1980, p. 138.

Grupping, et al., "Fundamentals of Oilwell Jet Pumping", SPE Production Engineering, Feb. 1988, pp. 9-11.

Fleshman, et al. "Artificial Lift for High-Volume Production", Oilfield Review (Schlumberger Publishing), Spring 1999, pp. 49-50.

Noronha, et al. "An Improved Two-Phase Model For Hydraulic Jet Pumps", SPE Production Operations Symposium, Oklahoma City, OK, Mar. 9-11, 1998, p. 76.

* cited by examiner

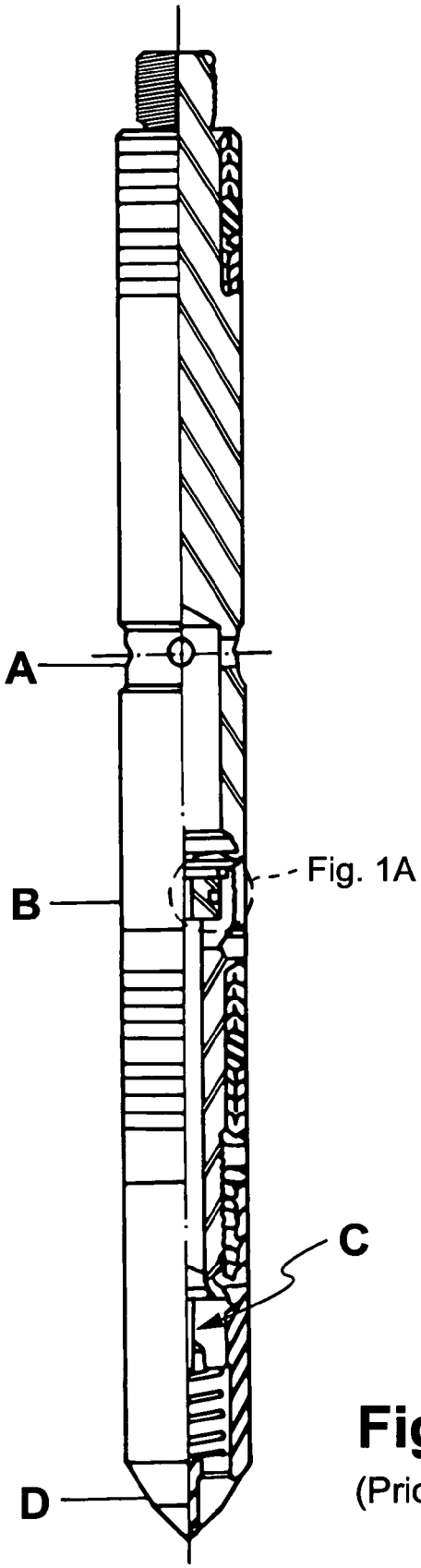
Fig. 1
(Prior Art)
Fig. 1A
(Prior Art)
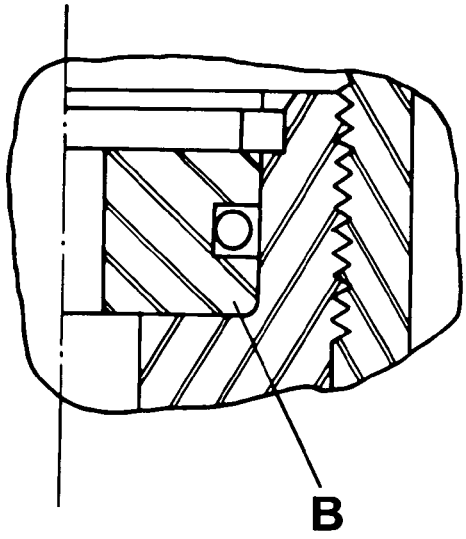

GAS FLOW CONTROL DEVICE

This is a Continuation of application Ser. No. 08/186,469 filed Jan. 26, 1994, now abandoned.

BACKGROUND OF THE INVENTION

The present invention is directed to a gas flow control device and more specifically to a gas flow control device for use in oil wells producing by continuous gas-lift. Such a gas flow control device is sometimes referred to in the industry as a gas-lift valve having a housing and a valve seat. The latter terminology is used throughout the specification.

At wells where production is by continuous gas-lift a valve commonly used in working of the well is referred to as a gate valve. It is the valve which lets in gas from between the annulus and the production pipe, into the latter. At a given stage of well discharge production is carried out by means of this gas.

Gate valves consist mainly of a gate which is preset at a given diameter, which does not change as long as the valve is within the well. Flow of gas past this gate is highly irreversible and therefore much load is lost and also it is difficult to calculate rate of flow of gas past the valve, thereby complicating any design or examination.

SUMMARY OF THE INVENTION

This invention is of an improvement to the seat of this kind of valve, with the aid of an optimum geometric arrangement of such seat so as to render flow isoentropic within the valve, thereby greatly reducing the unsuitable effects referred to in the geometry currently adopted. This new idea consists of a so-called compact venturi which is the result of coupling a tapering nozzle to a conical diffuser. This device is almost as efficient as a regular venturi, though quite a lot shorter (a requirement as regards the valve) and much easier to make, therefore cheaper.

Use of this kind of geometry leads to a rise of about 20% in the possible rate of flow of gas through the valve for the same pressure differential between casing and pipe, or, also, a drop of 7% to 20% in casing pressure needed to withstand the same flow of gas at same pipe pressure (usually the higher of these two figures applies).

A good example of an instance of when the newly-invented valve would be needed is that of satellite wells in deep water where heavy flow and high pressure occur.

BRIEF DESCRIPTION OF THE DRAWINGS

Invention will now be described in greater detail with the aid of the drawings attached hereto, where:

FIG. 1 part section view of a gate valve of the kind in current use, and FIG. 1*a* shows an enlarged view of a section of seat;

FIG. 1 is a sketch of a gate valve type of gas-lift valve currently in use. In the Figure there is a point marked A where gas enters the valve, passes through the valve seat B (that is, the gate), passes check valve C and leaves out of nose D for the inside of the pipe, FIG. 1 also shows a detailed view in section of the seat, shown as a sketch in FIG. 2, in which the cylindrical body of valve 1 can be seen, the housing 2 for the seat, and the seat 3, the gate 4 and o ring 5.

It will be seen that seat 3 is just a disk in which a cylindrical hole of the wanted diameter has been drilled. Edges are, as a rule, sharp but they may also be slightly chamfered B.

Figure 2:
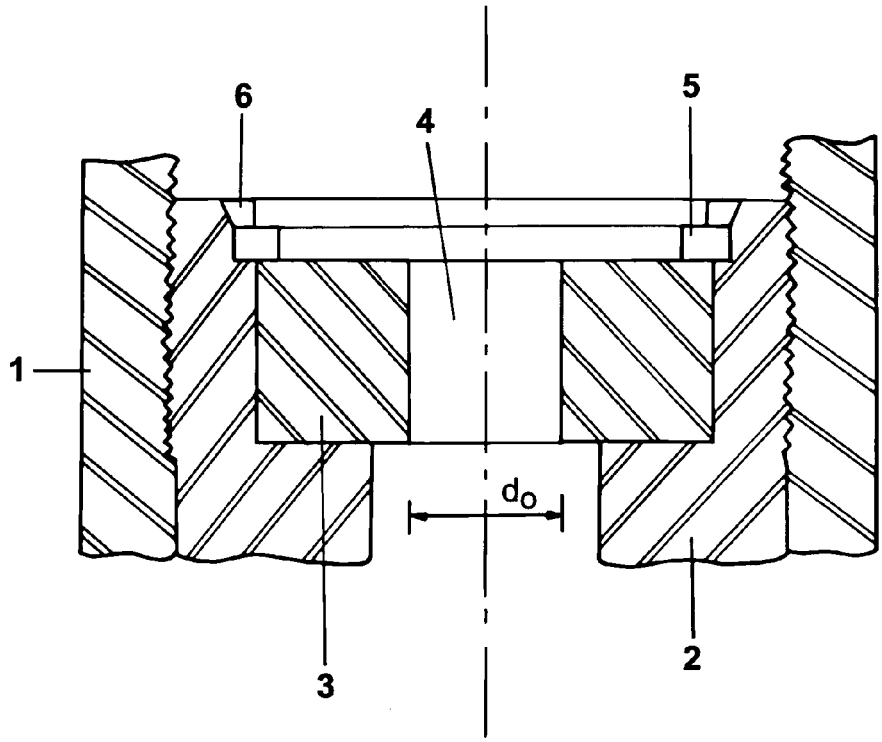
Fig. 2 (Prior Art)
FIG. 2 is a full cross-sectional view of said seat.
Figure 3:
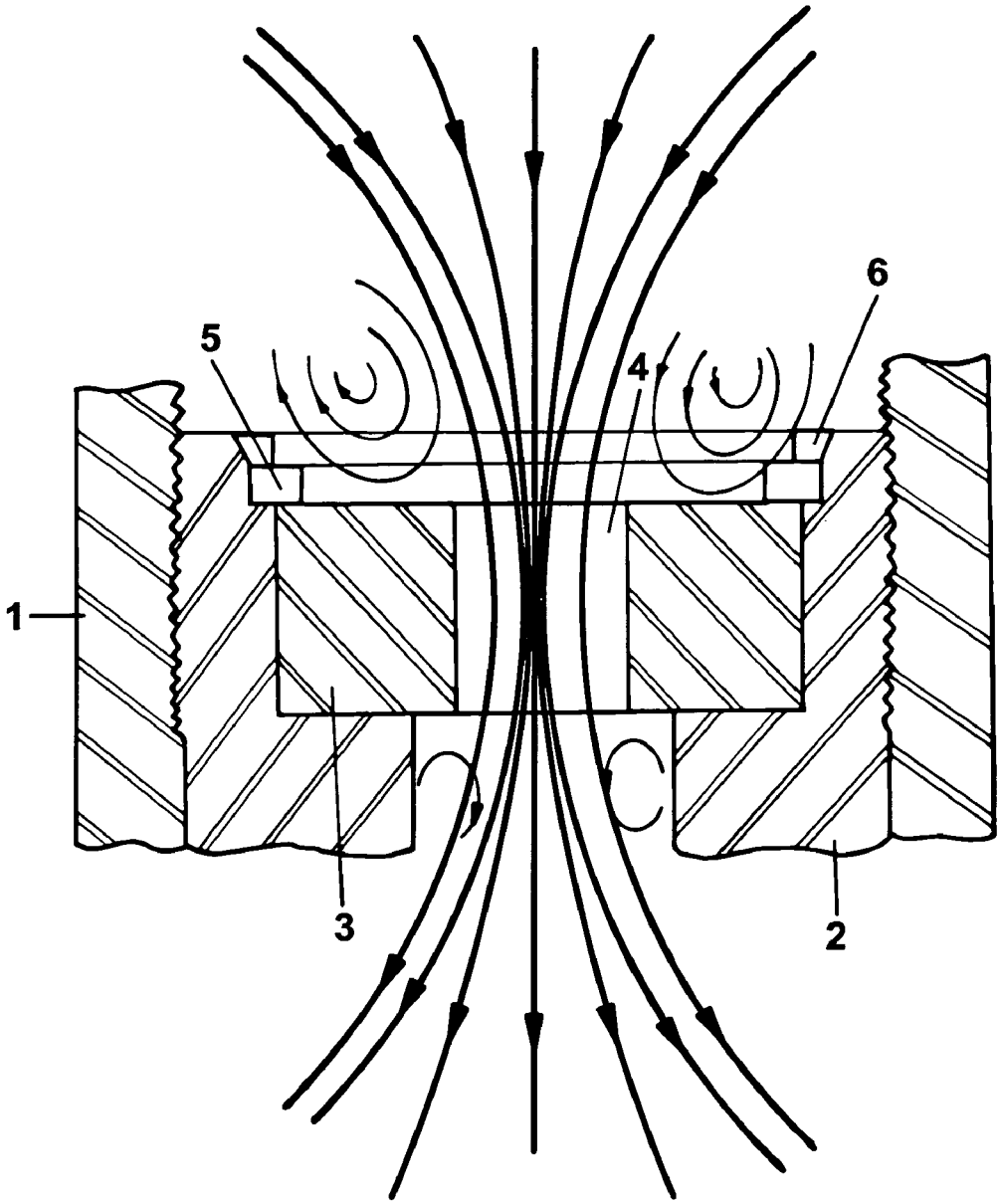
Fig. 3 (Prior Art)
FIG. 3 is a view similar of FIG. 2 showing gas flowing through it.

FIG. 3 is a sketch of flow lines through the gate 4 as through seat 3. Sudden contracting and expanding causes swirls which bring about heavy load losses. Furthermore, the smallest area of flow does not take place along the tight part (seat) but rather, further on, as a phenomenon known as "vena contracts".

Usual kind of modelling consists in supposing an isoentropic flow (reversible adiabatic flow) and then introducing a correction factor (discharge factor), theoretical results being compared with those arrived at experimentally. However, this discharge factor is difficult to express for it depends on several other factors, many of them intangible as regards any theoretical modelling. Hence any designing and study of continuous gas lifting becomes difficult because they depend on proper calculation of gas discharge rates through the valves. Furthermore, the irreversibilities introduce an extra load loss into the system (this is transformed unnecessarily into heat).

Figure 4:
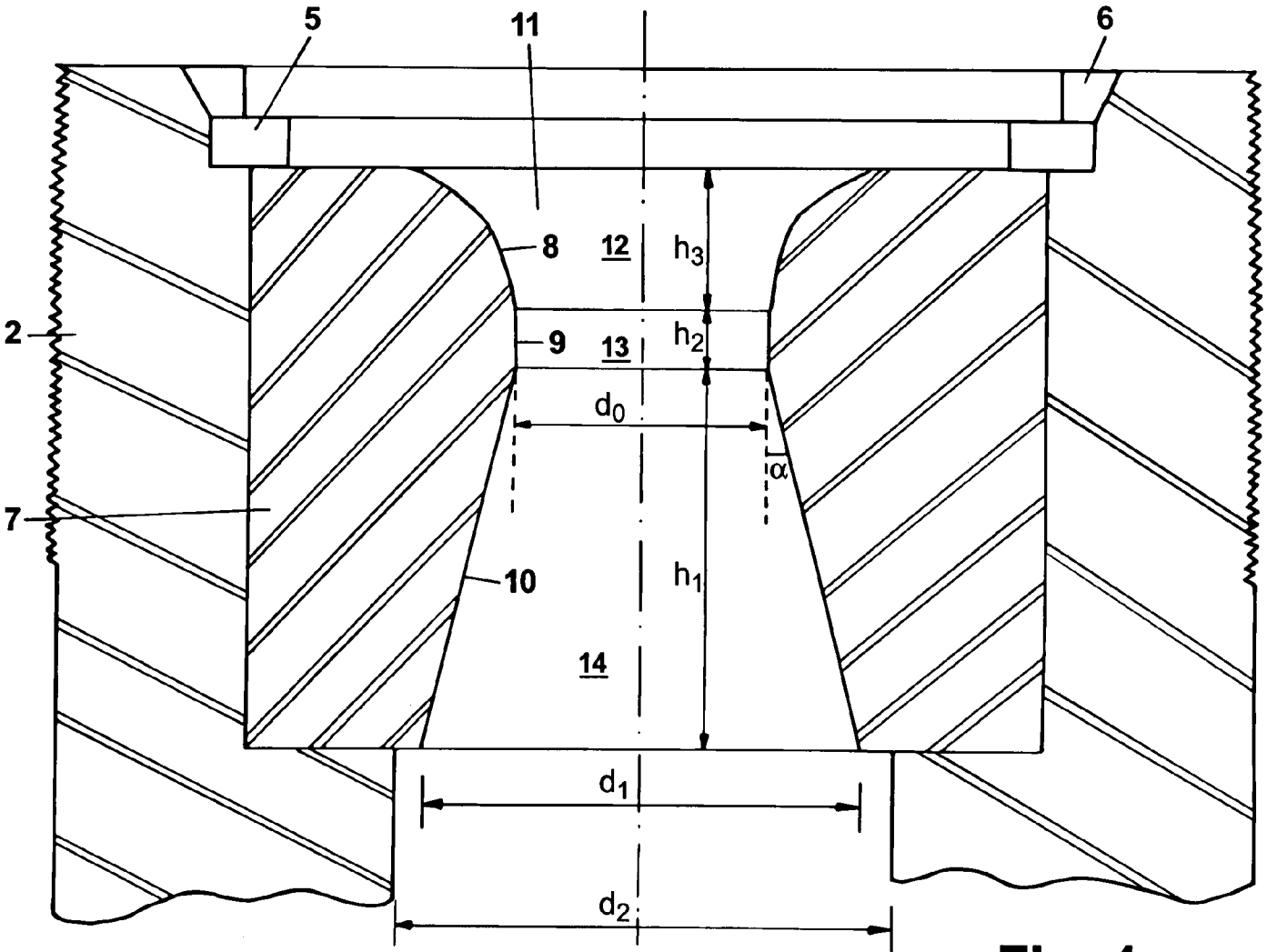
FIG. 4 is an enlarged cross section of the improved seat according to the present invention used in the gate valve.

In order to diminish the abovementioned drawbacks this invention provides a new kind of geometry for seat 7 as shown in the enlarged sketch of the section at FIG. 4.

The improved seat 7 has a curved upper part 8, a straight intermediate vertical part 9, and a straight sloping lower part 10, with central space 11 consisting of a first sloping nozzle kind of part 12, where gas is gradually speeded up; a second cylindrical part 13 diameter of which is the same as that wanted for the gate and which represents main restriction to flow, and a third part 14 in the shape of a conical diffuser, where gas is gradually slowed down. Thus irreversibilities are diminished and the place where flow is least lies at the second part 13, the vena contracts phenomenon being thereby avoided.

Angle $\alpha$ which is responsible for length H1 of the third part 14 is limited by whatever length is available (this being more critical in 1½" valves unless modifications are made to the body thereof). Diameter d1 may be the same as d2, but generally, for assembly reasons, is slightly less. Likewise, second part 13 may be reduced, theoretically, to one only part but, also for practical reasons, its length should always be h2 even though small, and h3 should be the length of the first part 12 shaped like a sloping nozzle.

This arrangement is of ten referred to in literature as a compact venturi, since it is like the ordinary venturi, but quite a lot shorter and easy to make, without however leading to any great differences in performance.

The invention claimed is:

1. In an oil well having a casing with tubing concentrically disposed therein, an apparatus for controlling gas lift, said apparatus comprising a gas lift valve mounted on said tubing and having an inlet end in communication with a space between said tubing and said casing and an outlet in communication with an interior of said tubing, said gas lift valve consisting of a housing and a nozzle mounted in said housing, said nozzle having a continuously open passage through which gas is allowed to flow, wherein said passage consists of a curved inlet portion through which gas flow is speeded up, a smooth straight, intermediate portion providing a main restriction to gas flow and a smooth, outwardly tapered, conical shaped outlet portion through which said gas flow is gradually slowed down, reducing the gas pressure loss and rendering gas flow substantially isoentropic.

2. In an oil well having a casing and a tubing with an annulus defined therebetween, an apparatus for controlling the flow of gas from said annulus into said tubing, said apparatus comprising:

a gas lift valve mounted on said tubing and having an inlet end in communication with said annulus for admitting gas from said annulus into said gas lift valve, and an outlet end in communication with an interior of said tubing, for discharging gas into said tubing;

said gas lift valve including a housing and a nozzle mounted in said housing, said nozzle being provided with a continuously open passage through which gas is allowed to flow, said passage comprising:

a convergent inlet portion through which gas flow is gradually accelerated, and a divergent outlet portion through which said gas flow is gradually slowed down, thereby reducing the gas pressure loss and rendering the gas flow substantially isoentropic.

3. An oil well as in claim 2, further comprising:

a smooth straight intermediate portion located between said convergent inlet portion and said divergent outlet portion, said intermediate portion providing a main restriction to said flow.

4. In a gas lift system for injecting pressurized gas into a well having a production string, a gas flow control valve comprising:

a housing including at least one inlet port and at least one outlet port;

an orifice comprising a nozzle portion and a diffuser portion;

said nozzle portion including a nozzle first end, a nozzle second end, and a nozzle flow path between said nozzle first end and said nozzle second end; said nozzle flow path converging from said nozzle first end to said nozzle second end, such that the gas experiences a decrease in pressure;

said diffuser portion including a diffuser first end and a diffuser second end, and a diffuser flow path therebetween, said diffuser flow path diverging from said diffuser first end to said diffuser second end, such that the gas experiences a rise in pressure, said diffuser first end being disposed adjacent said nozzle second end, such that a throat is defined therebetween, said diffuser flow path being aligned with said nozzle flow path to provide a continuous flow path;

whereby pressurized gas can flow into said at least one inlet port of said gas flow control valve through said continuous flow path, and out through said at least one outlet port into a production string.

5. A gas lift system as in claim 4, further comprising a check valve downstream from said diffuser portion responsive to said flow of pressurized gas.

6. The device of claim 4 wherein said diffuser has a conical contour.

7. A device for controlling a flow of gas from an external source into well tubing to enhance lift of fluid in the tubing comprising:

a gas lift valve insertable in the tubing, said valve having a housing with an upper portion having at least one inlet port for admitting the gas from the external source into the valve, a lower portion having at least one outlet port for discharging the gas from the valve into the tubing and a mid-portion extending therebetween on a longitudinal axis, and an orifice mounted within said housing mid-portion, said orifice having a throat transverse to and symmetrical about said longitudinal axis, a nozzle extending upwardly from said throat and diverging symmetrically outwardly from said axis and a diffuser extending downwardly from said throat and diverging symmetrically outwardly from said axis, said orifice defining a path of flow of gas from said upper portion to said lower portion of said housing;

said nozzle including a nozzle first end, a nozzle second end, and a nozzle flow path between said nozzle first end and said nozzle second end, said nozzle flow path converging from said nozzle first end to said nozzle second end, such that the gas experiences a decrease in pressure;

said diffuser including a first end and a second end, and a diffuser flow path therebetween, said diffuser flow path diverging from said diffuser first end to said diffuser second end, such that the gas experiences a rise in pressure, said diffuser first end being disposed adjacent said nozzle second end, such that flow is achieved in said throat, said diffuser flow path being aligned with said nozzle flow path to provide a continuous flow path;

whereby said gas flows into said at least one inlet port of said housing through said continuous flow path, and out through said at least one outlet port into said tubing.

8. A device as in claim 7, further comprising a check valve disposed downstream from said diffuser portion and responsive to said flow of gas.

9. The device of claim 7, wherein said diffuser has a conical contour.

10. A method for achieving flow through a flow control valve in a well having a tubing concentrically spaced within a casing by an annulus, comprising the steps of:

placing a gas lift valve within the well, at a predetermined location, said gas lift valve having an inlet end in communication with said annulus, and an outlet end in communication with an interior of said tubing;

flowing compressed gas into the annulus;

flowing the compressed gas from the annulus into a convergent nozzle portion of the gas lift valve;

gradually accelerating gas flow through said nozzle portion;

gradually slowing down said gas flow in a divergent outlet portion of the gas lift valve, thereby reducing the gas pressure loss and rendering the gas flow substantially isoentropic; and mixing gas ejected from the outlet portion of the gas lift valve with reservoir fluids in the tubing.

11. A method as in claim 10, further comprising flowing gas ejected from the outlet portion through a check valve before said mixing step.

* * * * *